United States Patent [19]

Bruce

[11] Patent Number: 4,647,042

[45] Date of Patent: Mar. 3, 1987

[54] SPORTS TRAINING APPARATUS

[75] Inventor: William D. Bruce, Baton Rouge, La.

[73] Assignee: Rally Mate Inc., Clinton, Miss.

[21] Appl. No.: 758,766

[22] Filed: Jul. 25, 1985

[51] Int. Cl.[4] ..... A63B 69/40

[52] U.S. Cl. ..... 273/26 E

[58] Field of Search ..... 273/26 R, 26 E, 29 A, 273/200 R, 200 B, 196, 197 R, 197 A, 55 A, 319, 413, 414

[56] References Cited

U.S. PATENT DOCUMENTS

| | | | |
|---|---|---|---|
| 2,017,720 | 10/1935 | Lake | 273/26 E |
| 2,862,712 | 12/1958 | Delta et al. | 273/26 E |
| 3,166,316 | 1/1965 | O'Leary | 273/26 E |
| 3,194,557 | 7/1965 | Holley | 273/26 E |
| 3,489,411 | 1/1970 | Morelli et al. | 273/26 R |
| 3,843,126 | 10/1974 | Bandy | 273/414 |
| 4,175,744 | 11/1979 | Llewellyn | 273/26 E |

FOREIGN PATENT DOCUMENTS

| | | | |
|---|---|---|---|
| 183766 | 8/1922 | United Kingdom | 273/200 R |
| 281064 | 12/1927 | United Kingdom | 273/196 |

*Primary Examiner*—Richard C. Pinkham
*Assistant Examiner*—T. Brown
*Attorney, Agent, or Firm*—Roy, Kiesel, Aaron & West

[57] ABSTRACT

A sports training device which can be utilized to teach consistency in motion constructed of a support-base having a vertically extending pole with a perpendicular arm to which a ball is suspended by a flexible line and having positioning plate adjustably attached to the support base so as to protrude at a desired position from the support base. The support-base has cavities into which weights may be inserted and locked in place.

2 Claims, 3 Drawing Figures

SPORTS TRAINING APPARATUS

BACKGROUND OF THE INVENTION

1. Field of the Invention

This invention related generally to sports training devices, and more particularly to such a device that can be used in a multitude of sports to teach consistency in motion.

2. Prior Art

In many of the popular sports such as football, tennis, baseball, volleyball, handball, racquetball, soccer, etc., excellence is obtained through the development of consistency in a particular body motion used in that sport. This is particularly true in those sports involving a head or arm motion.

To assist instructors, numerous devices have been developed and marketed, some of which are relatively useful. However, most of these devices' usefulness are restricted to only one or two sports. Therefore, high school athletic departments are forced to purchase many different training devices or to do without. A second major problem is that these devices do not force the athlete to be consistent in the motion being taught.

SUMMARY OF THE INVENTION

Therefore, it is an object of this invention to provide a training device which can be used in a multitude of sports to teach consistency in motion.

Another object of this invention is to provide a training device that forces the athlete to repeat certain motions in a consistent manner.

Other objects and advantages of this invention shall become apparent from the ensuing description of the invention.

Accordingly, a sports training device is described comprising a support base having a vertical extendable pole attached thereto, provided with an arm member that extends beyond the support base, a ball attached by a flexible line to the arm member and a positioning plate adjustably attached to the support base to protrude at a pre-determined distance from the support base.

PREFERRED EMBODIMENTS OF THE INVENTION

Figure 1:
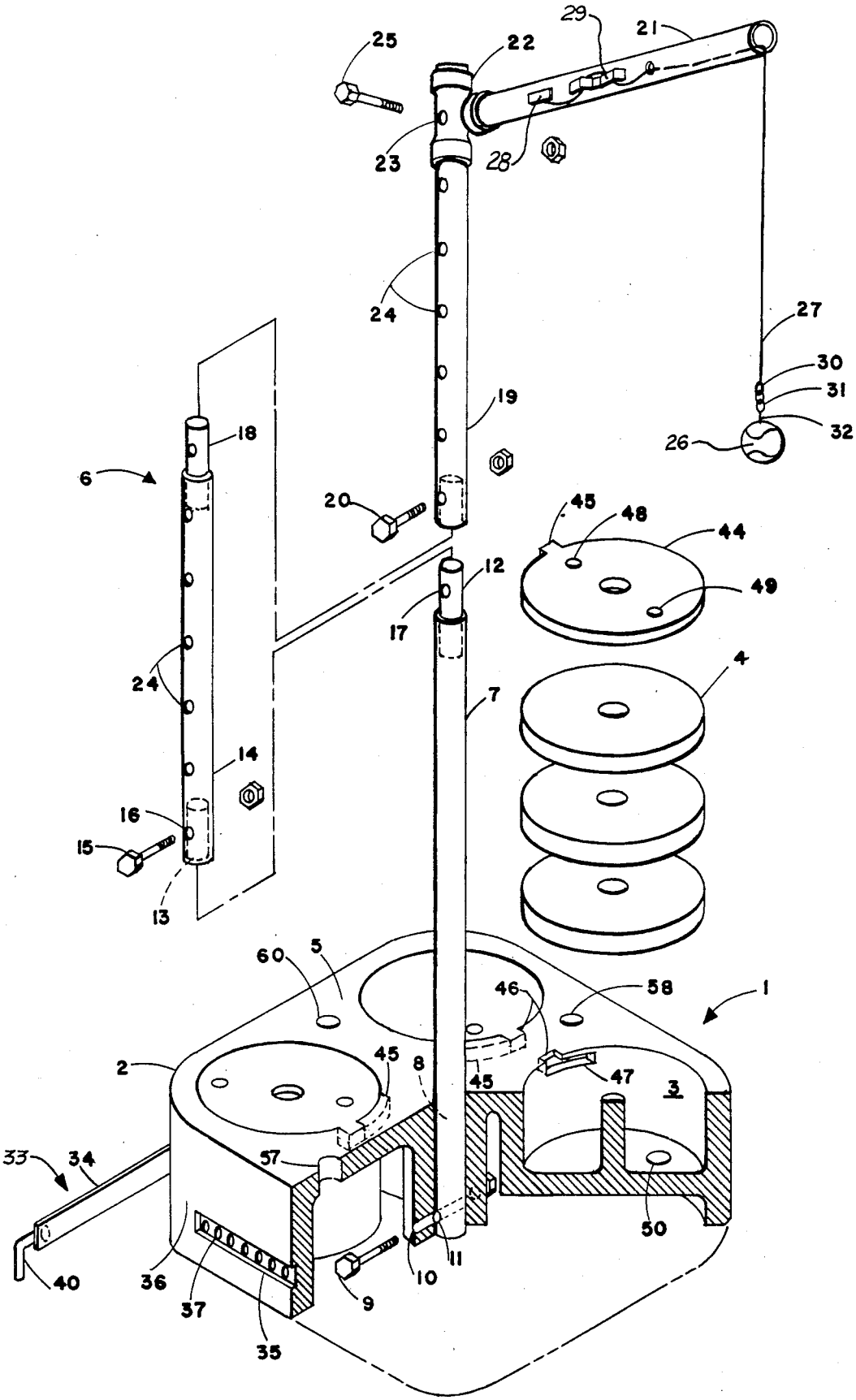
FIG. 1 is an exploded, cutaway three dimensional view of a preferred embodiment of the invention.

Referring now to FIG. 1, a preferred embodiment of the sports training device, denoted generally by the numeral 1, comprises a support base 2 having cavities 3 into which removable weights 4 can be placed. Perpendicularly extending from support base upper surface 5 is a pole assembly 6. Comprising a lower pole segment 7 which extends through a center channel 8 and is secured to support base 2 by bolt 9 that passes through support base bolt opening 10 and lower pole segment bolt opening 11 as illustrated in the figures. A segment connector 12 extends from one end of pole segment 7 and is shaped to fit into cavity 13 of a second pole segment 14 which can then be secured into position by bolt 15 which can pass through aligned securing holes 16 and 17. A second pole segment connector 18 similarly extends from the top of the second pole segment 14 so that top pole segment 19 can be attached by bolt 20 in the manner described above. Although only three pole segments are illustrated, one can add as many or few pole segments as necessary for the particular sport technique being taught.

Extending outward from pole assembly 6 is arm member 21 that attaches to either the second or top pole segments 14 or 19, respectively, by arm member 21 being attached to collar member 22 which has bolt opening 23 alignable with one of the pole segment bolt openings 24, as illustrated, by collar securing bolt 25. Thus, the height of arm member 21 from the ground can be adjusted by sliding collar member 22 up or down pole segments and securing it at the desired height by bolt 25.

Ball 26 is secured to arm member 21 by flexible line 27. In a preferred embodiment line 27 will be black so as to be less distractive to the person training on the device. It has also been found that a flat line provides truer action and is also preferred. Finally, it is preferred that line 27 be of a length so that ball 26 extends between 3 and 4 feet below arm member 21. In a still more preferable embodiment, it is preferred that the length of line 27 can be adjusted. One embodiment to accomplish this is to provide anchor means 28 to which one end of line 27 is fixedly attached and to provide a line securing member 29 located on arm member 21 to which the line 27 can be wrapped.

In a special preferred embodiment the extending end of line 27 is provided with ring 30 to which ball 26 is attached by clip 31 connected to ball 26 by short flexible line 32. In this manner an instructor can easily change the type of ball that is to be used for training; e.g. from tennis to volleyball, to baseball, to soccer ball, to football, etc.

Player positioning means 33 consists of one or more bars 34 that can adjustably be secured in grooves 35 that extend horizontally to the ground along each side 36 of support base 2. In one preferred embodiment grooves 35 can be provided with threaded openings 37 through which threaded bolt 38 first passes through one of the bar openings 37 so as to position bar 34 at the desired position. Through the proper positioning of bars 34 an athlete will not be able to "creep" toward the ball with each successive exercise as is the tendency with present training devices thus assuring that each motion will be made at a pre-set distance from the ball.

In a preferred embodiment, each bar 34 will have stablizing feet 40 which extend to the ground that help maintain bar 34 in position.

Figure 3:
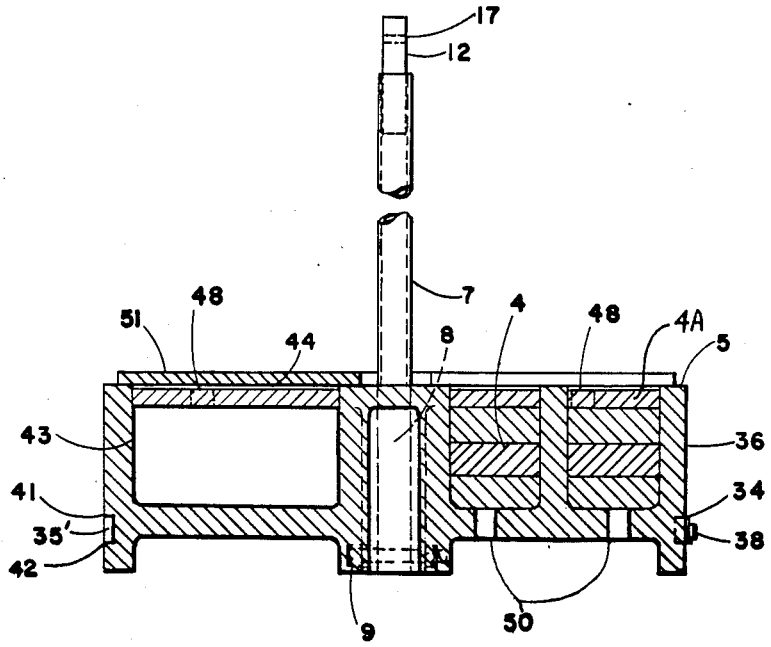
FIG. 3 is a cross-sectional view taken along lines I—I of FIG. 1.

In an alternate preferred embodiment illustrated in FIG. 3, groove 35' has an upper outer lip 41 and a lower outer lip 42 which permits bar 34 to slide in groove 35'.

In another alternate preferred embodiment as seen in FIG. 3, weights 4 may consist of a single container 43 having a removable top 44 to allow sand, water or other heavy material to be poured.

In still another preferred embodiment either top weight 4A or top 44 can be provided with a locking tab 45 that fits through slot 46 (See FIG. 1) and when rotated into securing groove 47 to prevent the weights from falling out in the case support base 2 is knocked over. To assist in rotating weight 4A or top 44 finger opening 48 and 49 can be provided. In the event it is desired to remove support base is preferably provided with bottom openings 50 leading to support base cavities 3 to allow the weights to be pushed from the bottom.

Figure 2:
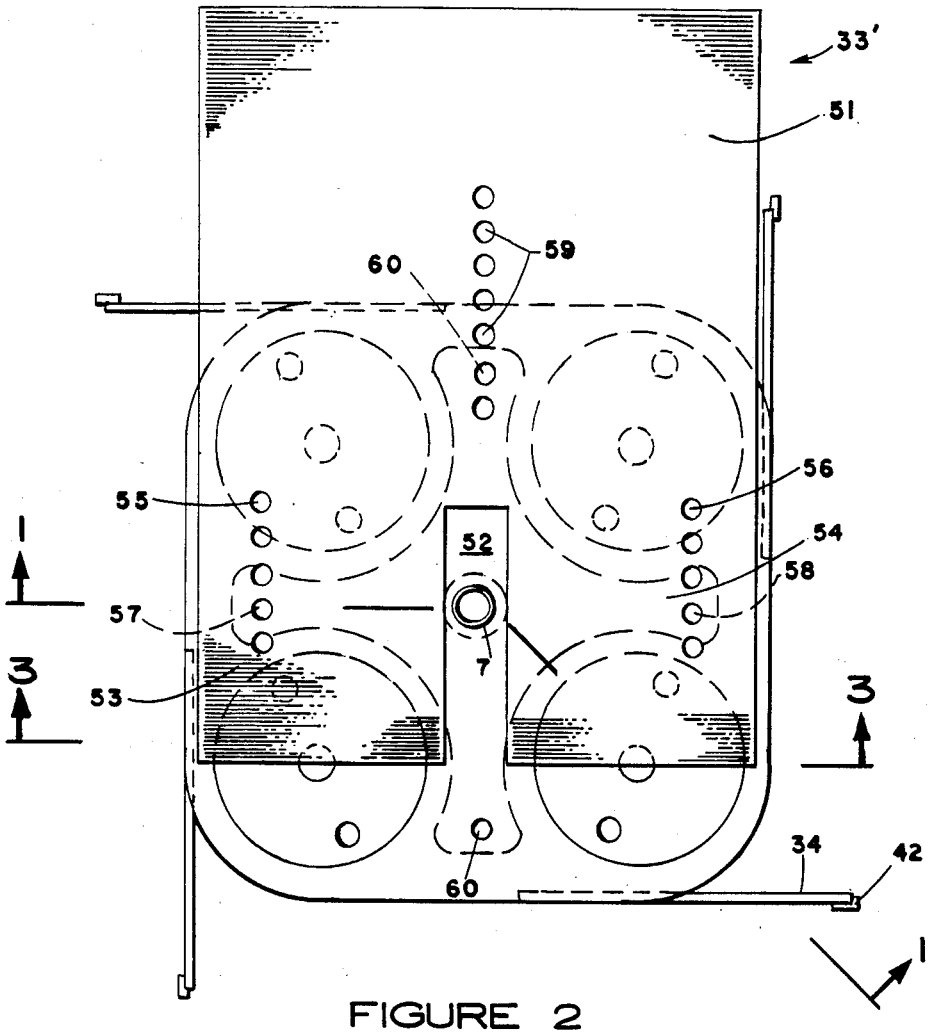
FIG. 2 is a top view of the support base of a preferred embodiment of the invention.

An alternate embodiment of player positioning means 33′ is illustrated in FIG. 2 and comprises rectangular plate member 51 having a slot 52 cut in one side to allow plate sections 53 and 54 to pass on either side of lower pole segment 7. Sections 53 and 54 are each provided with a series of openings 55 and 56, respectively, which can be positioned over opposite support base openings 57 and 58, respectively, to allow a securing pin (not shown) to hold plate member 51 in the desired position. In a preferred embodiment plate member 51 is provided with a third series of opening 59 that is alignable with one of the other support base openings 60 wherein a third securing pin can be placed.

Thus with the invention as described, an instructor can quickly and easily adjust the height of ball 26 depending on the game being taught as well as the size of the athlete. He can also make similar adjustments of the positioning means 33 or 33′ to facilitate the instructions to a class of athletes. In addition the device is controlled so as to be easily stored or transported. Finally, its size allows for training indoors in a relatively small space.

There are of course other obvious alternate embodiments not specifically illustrated, but which are intended to be included within the scope of the invention as defined by the following claims.

What I claim is:

1. A sports training apparatus which comprises:

(a) a support base comprising a body having movable weights positionable in one or more vertical cavities formed by an upper wall in said body wherein (i) said upper wall of said cavities have a horizontal groove extending partially around said upper wall and have a vertical slot connecting said groove and the top surface of said support base, and (ii) said weights having a protruding tap, shaped to pass down said slot and rotatable into said groove, (b) an extendable pole vertically attached to said support base and having an arm member perpendicularly attached to said pole and of a length to extend beyond said support base, (c) a ball attached by a flexible line to said arm member, and (d) a player positioning means adjustabley attached to said support base such that a portion thereof will protrude at a pre-determined distance from said support base.

2. A sports training apparatus which comprises:

(a) a support base, (b) an extendable pole vertically attached to said support base and having an arm member perpendicularly attached to said pole and of a length to extend beyond said support base, (c) a ball attached by a flexible line to said arm member, and (d) a player positioning means adjustably attached to said support base such that a portion thereof will protrude at a pre-determined distance from said support base wherein said support base has a flat upper surface with at least three columns of pin receiving openings and wherein said positioning means comprises a flat rectangular plate having at least three columns of pin receiving openings, said columns of openings in said base and said plate being aligned when said plate is positioned on said base, said plate further having a slot extending perpendicularly from a mid-point of one side to form a U-shaped member, said slot extending along a center line of said plate and having a width sufficient to allow said extendable pole to pass perpendicularly through three columns of plate openings which can be aligned with said openings in said base, and wherein removable securing pins are fitted in selected aligned pin openings and plate openings when said positioning plate is positioned on said support base.

* * * * *